United States Patent [19]

Plummer et al.

[11] Patent Number: 4,582,131

[45] Date of Patent: Apr. 15, 1986

[54] SUBMERSIBLE CHEMICAL INJECTION PUMP

[75] Inventors: Leonard M. Plummer; Derry E. Banta; Vance A. Wilczek, all of Rangely, Colo.

[73] Assignee: Hughes Tool Company, Houston, Tex.

[21] Appl. No.: 654,824

[22] Filed: Sep. 26, 1984

[51] Int. Cl.[4] ..... E21B 41/02; E21B 37/06

[52] U.S. Cl. ..... 166/68; 166/902; 166/310

[58] Field of Search ..... 166/68, 244 C, 300, 166/304, 310, 311, 312, 371, 106, 101, 183, 54, 72, 105–112, 68.5

[56] References Cited

U.S. PATENT DOCUMENTS

| | | | |
|---|---|---|---|
| 2,551,434 | 5/1951 | Gray et al. | 166/72 |
| 2,808,111 | 10/1957 | Krueger | 166/101 |
| 3,335,791 | 8/1967 | Patton | 166/310 |
| 3,548,946 | 12/1970 | Engle | 166/310 |
| 3,901,313 | 8/1975 | Doniguian et al. | 166/64 |
| 4,326,585 | 4/1982 | McStravick | 166/244 |
| 4,386,653 | 7/1983 | Drake | 166/105 |

OTHER PUBLICATIONS

Cruise et al., "Use of Continuous Tubing for Subsurface Scale and Corosion Treating-Rangely Weber Sand Unit", SPE paper #11853, May 23-25, 1983.

*Primary Examiner*—Stephen J. Novosad
*Assistant Examiner*—David J. Bagnell
*Attorney, Agent, or Firm*—Robert A. Felsman; James E. Bradley

[57] ABSTRACT

An electrical submersible well pump installation has a downhole secondary pump for pumping scale inhibiting chemicals below the downhole pumping assembly. The downhole pumping assembly includes a centrifugal primary pump driven by an electrical motor located below the pump and separated by a seal section for preventing well fluids from entering the motor. The secondary pump is also driven by the motor and is located between the seal section and the primary pump. The secondary pump has an intake connected to a tube that extends upwardly above the intake of the primary pump. The secondary pump has a discharge port connected to a discharge tube that extends downwardly to a point below the motor. Chemicals introduced at the surface into the annulus flow downwardly into the intake of the secondary pump and are discharged below the motor. The secondary pump has an inverted impeller and diffuser that have a discharge on the lower end for discharging fluids downwardly.

3 Claims, 4 Drawing Figures

21
19
23
15
11
87
13
17
25
27
35
29
83
33
31
37
39
47
43
45
41
49
51
53
89
85 both, for the discharge of chemicals received from the discharge tube 39.

Referring to FIG. 2, secondary pump 31 has a tubular housing 57. An upper adapter 59 is screwed into the upper end of the housing 57. Bolts 61 enable the adapter 59 to be bolted to the lower end of the primary pump 27. A lower adapter 63 is screwed into the lower end of the housing 57. Bolts 65 enable the lower adapter 63 to be bolted to the upper end of the seal section 41. A shaft 67 extends concentrically through the housing 57, and is rotatably supported in a conventional manner by components shown but not specifically numerated. An upper coupling 69 rotatably couples shaft 67 to shaft 71, which extends through the primary pump 27 for driving the primary pump 27. A lower coupling 73 couples the lower end of the shaft 67 to shaft 43 of the seal section 41.

A diffuser 75 is stationarily mounted in the housing 57 about halfway between the upper and lower ends. Diffuser 75 has a plurality of curved passages 77 that extend from the periphery inwardly and downwardly. An impeller 79 is mounted inside the diffuser 75. The impeller 79 has a plurality of passages 81 that have an intake on the upper side and outlets at the periphery spaced below the intake of the passages 81. The outlets register with the diffuser passages 77. Impeller 79 and diffuser 75 are conventional, except that they are mounted in an inverted manner from the impellers and diffusers (not shown) of the primary pump 27. The intake to the impeller 79 and diffuser 75 assembly faces upwardly in housing 57 and the discharge of the assembly faces downwardly in the housing 57.

Referring to FIG's. 1A, 1B, and 1C, in operation, electrical power will be supplied to the motor 49, which will rotate shafts 43, 67 and 71 (FIG. 2). As indicated by arrows 83 in FIG. 1C, fluid from perforations 85 in the casing 13 will flow upwardly around tail pipe 51, motor 49, seal section 41, secondary pump 31 and into the intake 29 of the primary pump 27. The primary pump 27 will discharge the fluid into the tubing 15 to flow to the surface. Chemicals from chemical tank 21 will flow through the discharge line 23 into the top of the annulus 17. The suction at the intake 29 of primary pump 27 causes the chemicals and fluid in the annulus 17 to flow downwardly. As the fluid flows downwardly, as indicated by the arrows 87, some of the fluid will flow into the intake tube 35 and into the secondary pump 31.

Referring to FIG. 2, the fluid flows within the housing 57 into the intake of the impeller 79. The impeller 79 is spinning with the shaft 67, and forces the fluid outwardly through the passages 81 to the periphery of the impeller 79. The fluid then flows downwardly and inwardly through the passages 77 of the diffuser 75 at a higher pressure. The fluid flows out the discharge port 37 and into the discharge tube 39. From the discharge tube 39, the fluid flows into the tail pipe 51, FIG. 1*c*. As indicated by the arrows 89, the chemicals will discharge into the annulus 17 above the perforations 85 and below the motor 49. The chemicals will flow around the motor 49, seal section 41, chemical pump 31 and into the intake 29 of the primary pump 27. The chemicals will flow to the surface through the tubing 15 along with the produced well fluid. The capacity of the chemical pump 31 is about $3\frac{1}{2}$ to $4\frac{1}{2}$ gallons per minute, while a typical primary pump 27 might be pumping in a range of 100 gallons per minute, depending on well characteristics and pump size.

The invention has significant advantages. The chemical pump enables the chemicals introduced into the annulus at the surface to flow also around the components of the downhole pump assembly that are located below the intake of the primary pump. This reduces scale deposition on these components, lengthening the time between the need to pull the pump assembly for maintenance. Placing an impeller and diffuser in an inverted position, enables the discharge end of the chemical pump to be located below the intake of the pump. This avoids having to cross intake and discharge lines or to have complex passageways within the pump.

While the invention has been shown in only one of its forms, it should be apparent to those skilled in the art that it is not so limited but is susceptible to various changes without departing from the scope of the invention.

We claim:

1. In a well installation, having casing, a string of tubing extending to a downhole centrifugal pumping assembly, defining an annulus between the casing and the tubing and pumping assembly, and means at the surface for introducing inhibiting chemicals into the annulus, the pumping assembly including a centrifugal primary pump driven by an electrical motor located below the pump and separated by a seal section for preventing well fluids from entering the motor, the improvement comprising in combination:

a centrifugal secondary pump having an upper end adapted to be connected to the bottom of the primary pump and a lower end adapted to be connected to the top of the seal section;

the secondary pump having an intake port on its upper end adapted to be connected to an intake tube that extends above an intake of the primary pump, terminating in the annulus;

the secondary pump having a discharge port on its lower end adapted to be connected to a discharge tube that extends downwardly through the annulus alongside the motor to a point in the annulus below the motor, for pumping inhibiting chemicals drawn from the annulus to a location below the motor, which then flow upwardly around the motor and into the intake of the primary pump.

2. In a well installation having a casing, a string of tubing extending to a downhole centrifugal pumping assembly, defining an annulus between the casing and the tubing and pumping assembly, and means at the surface for introducing inhibiting chemicals into the annulus, the pumping assembly including a centrifugal primary pump which has an intake on its lower end and is driven by an electrical motor located below the pump, the improvement being a centrifugal secondary pump adapted to be connected to the pumping assembly, comprising in combination:

a tubular housing having an intake port on its upper end adapted to be connected to an intake tube that extends upwardly in the annulus to a point above the intake of the primary pump, and a discharge port on its lower end;

a shaft rotatably mounted in the housing and adapted to be driven by the motor; and an impeller and diffuser assembly mounted in the housing, having an intake facing upwardly in the housing and a discharge located below the intake of the impeller and diffuser assembly and facing downwardly in the housing, for pumping inhibiting chemicals drawn from the annulus downwardly

SUBMERSIBLE CHEMICAL INJECTION PUMP

BACKGROUND OF THE INVENTION

1. Field of the Invention

This invention relates in general to a submersible centrifugal well pump assemblies, and in particular to an assembly that includes also a downhole secondary pump for injecting scale inhibiting chemicals.

2. Description of the Prior Art

In a conventional well having a centrifugal pump assembly, the well will be cased and will have a string of tubing extending downward to the downhole pump assembly. The pump assembly includes a centrifugal pump mounted above an electrical motor. A seal section mounted between the pump and the motor protects against the entry of well fluid into the motor. Electrical power is supplied by cables extending to the surface. The pump has an intake on its lower end and discharges into the tubing.

In certain fields, scale deposition on the downhole equipment is a serious problem. Mineral scale depositing on the submersible pump assembly can lead to extensive damage. One prior technique used to inhibit the deposition of scale on the equipment is to introduce chemicals into the annulus between the tubing and the casing at the surface. The chemicals will flow downwardly in the annulus into the intake of the pump and back up the tubing. This retards the deposition of scale on the equipment from the intake of the pump inwardly. However, it will not prevent scale deposition below the intake of the pump, and the motor and seal section are located below the intake of the pump.

SUMMARY OF THE INVENTION

A secondary pump is incorporated into the downhole pump assembly for injecting chemicals below the motor. The secondary pump is mounted between the seal section and the primary pump. The secondary pump has an intake connected to an intake tube that extends upwardly above the intake of the primary pump. Chemicals introduced into the annulus at the surface will flow down the annulus and into the intake tube. The secondary pump has a discharge port connected to a discharge tube that leads to a point below the motor. The chemicals drawn into the intake of the secondary pump from the annulus are pumped downwardly out the discharge tube. The chemicals flow upwardly around the motor and back into the intake of the primary pump.

The secondary pump preferably is a single stage centrifugal pump driven by the motor which also drives the primary pump. An impeller and diffuser is mounted inside the housing of the secondary pump in an inverted manner from normal operation. The impeller intake is on the upper side, and the diffuser outlet is on the lower side. The impeller and diffuser stage pump the annulus fluid downwardly to the discharge port.

BRIEF DESCRIPTION OF THE DRAWINGS

FIG's. 1*a*, 1*b*, and 1*c* are simplified side views of a submersible pump well assembly having a chemical injection pump constructed in accordance with this invention.

DESCRIPTION OF THE PREFERRED EMBODIMENT

Figures 1A, 1B, 1C:
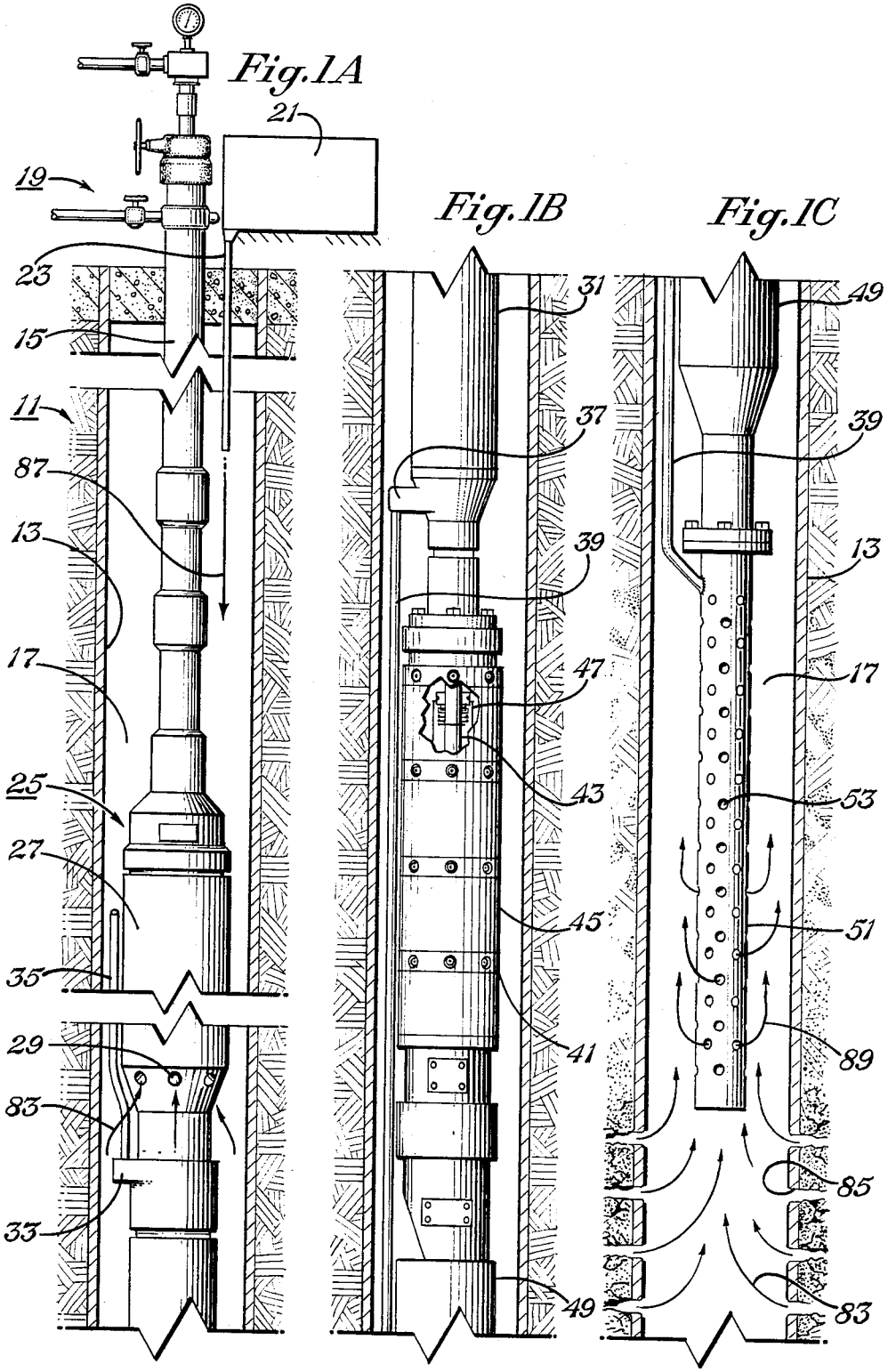
Figure 2:
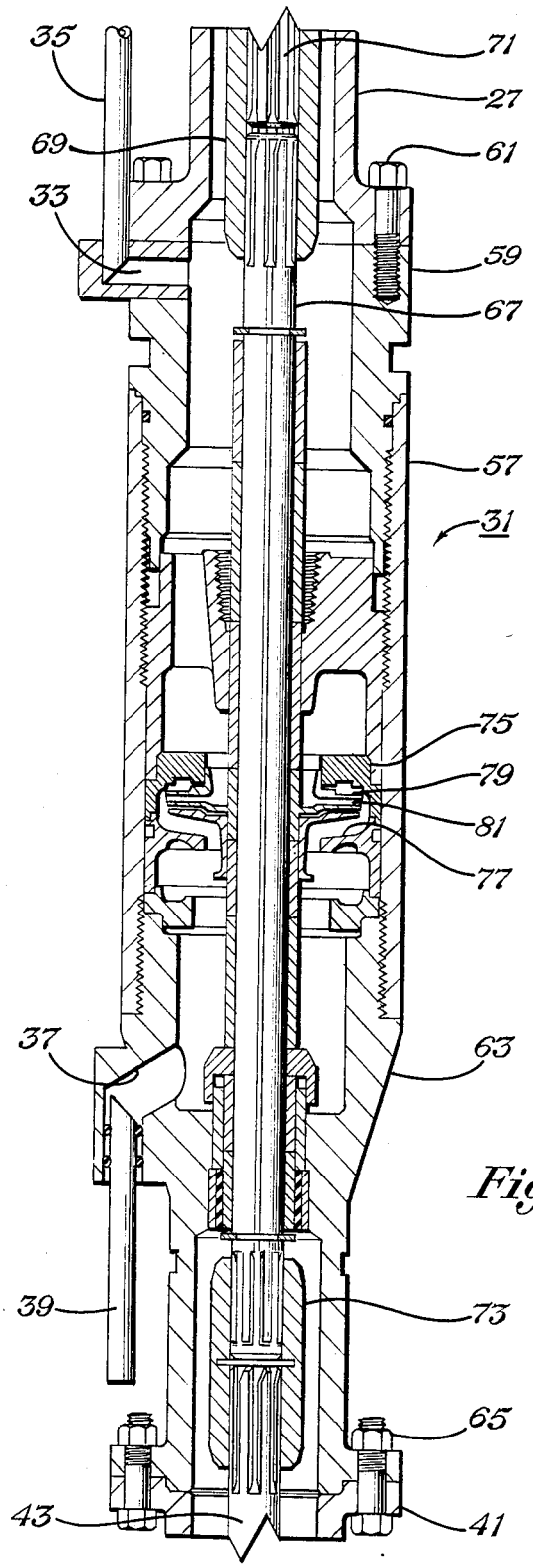
FIG. 2 is a vertical sectional view, enlarged, of the chemical injection pump of FIG. 1.

Referring to FIG. 1A, well 11 includes a string of casing 13 that is cemented in the well. A string of tubing 15 extends downwardly from the surface in the well, defining an annulus 17 between the tubing 15 and the casing 13. Control equipment 19 is located at the surface for controlling the flow of production fluid up the tubing 15 to the surface. A chemical tank 21 is located at the surface, containing chemicals for retarding scale and corrosion in the well. The chemical tank 21 has a discharge line 23 for introducing liquid chemicals from the tank by gravity into the top of the annulus 17. The discharge line 23 would extend no more than a few feet into the top of the well.

A downhole submersible pump assembly 25 is connected to the lower end of tubing 15 for pumping fluid from the formation up the tubing 15. The downhole submersible pump assembly 25 includes a primary pump 27. Primary pump 27 is a centrifugal pump having a plurality of stages of impellers and diffusers (not shown) stacked together in a conventional manner. Primary pump 27 has an intake 29 at its lower end. A typical primary pump 27 would have about 100–200 stages of impellers and diffusers.

Referring to FIG. 1B, a secondary pump 31 has its upper end directly connected to the lower end of the primary pump 27. The secondary pump 31 has an intake port 33 on its upper end that is connected to an intake tube 35. Intake tube 35 is a small tube that extends upwardly in the annulus 17 between the casing 13 and primary pump 27. The intake tube 35 terminates about 6 to 10 feet above the intake 29 of the primary pump 27. The upper end of the intake tube 35 is open for drawing in fluids from the annulus 17, including chemicals introduced from the chemical tank 21.

The secondary pump 31 has a discharge port 37 on its lower end that is connected to a discharge tube 39. Discharge tube 39 is also a small diameter tube that extends in the annulus 17 offset from the axis of the well. The discharge tube 39 extends downwardly.

The lower end of the secondary pump 31 is connected directly to the top of a seal section 41. Seal section 41 is a conventional component in downhole submersible pump assembly 25. Seal section 41 has a shaft 43 that extends through it for driving the secondary pump 31 and the primary pump 27. There are a number of chambers 45 spaced along the length of the seal section 41. Each chamber has a partition (not shown) separating it from the other chambers 45. A face seal 47 is mounted around the shaft 43 at each chamber to pevent the leakage of well fluid into the seal section 41. Seal section 41 will be filled with a lubricating oil. U.S. Pat. No. 4,406,462, Witten, Sept. 27, 1983, provides more details concerning seal sections of this nature.

Referring to FIG. 1C, an electrical motor 49 has its upper end connected to the lower end of the seal section 41 in a conventional manner. Electrical motor 49 is a large alternating current motor. Cables (not shown) lead from a power source at the surface to the electrical motor 49.

A tail pipe 51 is mounted to the lower end of the electrical motor 49. The discharge tube 39 extends in the annulus 17 alongside the seal section 41 and along side the motor 49. The discharge tube 39 extends downwardly into the tail pipe 51. Tail pipe 51 may have a plurality of aperatures 53, or an open lower end, or into the well, to be then drawn upwardly into the intake of the primary pump.

3. In a well installation having casing, a string of tubing extending to a downhole centrifugal pumping assembly, defining an annulus between the casing and the tubing and pumping assembly, and means at the surface for introducing inhibiting chemicals into the annulus, the pumping assembly including a centrifugal primary pump having an intake on its lower end and driven by a shaft of an electrical motor located below the pump and separated by a seal section for preventing well fluids from entering the motor, the improvement being a centrifugal secondary pump, comprising in combination:

a tubular housing;

connection means at the upper end of the housing for connecting the housing to the bottom of the primary pump;

connection means at the lower end of the housing for connecting the housing to the upper end of the seal section;

a shaft extending through the housing for rotation by the shaft of the motor;

an impeller and diffuser assembly mounted in the housing, having an intake facing upwardly in the housing and a discharge located below the intake of the impeller and diffuser assembly and facing downwardly for pumping fluid downwardly through the housing;

an intake tube adapted to be connected to the intake port and extending upwardly to a point in the annulus above the intake of the primary pump;

a discharge port in the housing below the impeller and diffuser assembly; and a discharge tube adapted to be connected to the discharge port and extending downwardly alongside the motor to a point in the annulus below the motor, for pumping inhibiting chemicals introduced into the annulus at the surface to a location below the motor, to then flow upwardly into the intake of the primary pump.

* * * * *